US009340921B2

(12) United States Patent
Fung et al.

(10) Patent No.: US 9,340,921 B2
(45) Date of Patent: May 17, 2016

(54) CHILLER BOX

(75) Inventors: Paul Y. Fung, South River, NJ (US); David Gubernick, Cherry Hill, NJ (US); Stephan M. Linkel, Ewing, NJ (US); Ching-Yun M. Yang, Princeton Junction, NJ (US)

(73) Assignee: Johnson & Johnson Consumer Inc., Skillman, NJ (US)

( * ) Notice: Subject to any disclaimer, the term of this patent is extended or adjusted under 35 U.S.C. 154(b) by 779 days.

(21) Appl. No.: 12/621,678

(22) Filed: Nov. 19, 2009

(65) Prior Publication Data

US 2010/0129556 A1 May 27, 2010

Related U.S. Application Data

(60) Provisional application No. 61/116,826, filed on Nov. 21, 2008.

(51) Int. Cl.

| | |
|---|---|
| ***B05D 3/00*** | (2006.01) |
| ***D06M 13/224*** | (2006.01) |
| ***D06M 13/00*** | (2006.01) |

(52) U.S. Cl.

CPC ..... *D06M 13/2243* (2013.01); *D06M 7/00* (2013.01); *D06M 13/224* (2013.01); *D06M 2200/40* (2013.01)

(58) Field of Classification Search

CPC ..... D06M 13/2243; D06M 7/00
USPC ..... 427/398.1
See application file for complete search history.

(56) References Cited

U.S. PATENT DOCUMENTS

| | | | | |
|---|---|---|---|---|
| 2,284,553 | A * | 5/1942 | Bennett | 118/60 |
| 3,084,449 | A | 4/1963 | Huffman | |
| 3,106,485 | A | 10/1963 | Guillet et al. | |
| 4,073,996 | A | 2/1978 | Bedenk et al. | |
| 4,517,255 | A * | 5/1985 | Kanda et al. | 428/626 |
| 4,567,673 | A | 2/1986 | Bohnensieker | |

(Continued)

FOREIGN PATENT DOCUMENTS

| | | | |
|---|---|---|---|
| GB | 896816 | A | 5/1962 |
| GB | 2287481 | A | 9/1995 |

(Continued)

OTHER PUBLICATIONS

Ophardt, Virtual ChemBook, Elmhurst College, c. 2003, Accessed: Jun. 22, 2012.*

*Primary Examiner* — Tabatha Penny

(57) ABSTRACT

A process for manufacturing robust, flexible sheet-like material, includes the steps of a) applying a waxy composition to the web to form a waxed web; b) leading the waxed web via at least one roller to a chiller; c) cooling the waxed web; and d) leading the waxed web to a collection station for collecting the waxed web for further processing. The waxy composition comprises about 10-60 wt-% of a waxy compound and about 90-40 wt-% of a diluent. The waxy compound is selected from the group consisting of A) monoesters of a polyhydric aliphatic alcohol and a fatty acid; B) diesters of a polyhydric aliphatic alcohol and a fatty acid; and C) mixtures of said monoesters and diesters. The coating forms a stable liquid mixture at a temperature between about 35° C. and about 100° C., has a liquefaction temperature of at least about 30° C., and has a contact angle with a flat surface of the substrate of less than about 35° when measured at a temperature of 60° C.

5 Claims, 7 Drawing Sheets

(56) References Cited

U.S. PATENT DOCUMENTS

| | | | | |
|---|---|---|---|---|
| 4,826,560 | A | | 5/1989 | Held |
| 4,844,766 | A | | 7/1989 | Held |
| 4,846,408 | A | | 7/1989 | Sallavanti et al. |
| 5,156,651 | A | | 10/1992 | Girardeau et al. |
| 5,363,902 | A | | 11/1994 | Kush |
| 5,389,374 | A | | 2/1995 | Brown Skrobot |
| 5,547,985 | A | | 8/1996 | Brown Skrobot et al. |
| 5,641,503 | A | * | 6/1997 | Brown-Skrobot ..... 424/431 |
| 5,679,369 | A | | 10/1997 | Brown Skrobot |
| 5,705,182 | A | | 1/1998 | Brown Skrobot |
| 6,058,844 | A | | 5/2000 | Niemiec |
| 6,113,981 | A | | 9/2000 | Ogilvie et al. |
| 6,316,019 | B1 | | 11/2001 | Yang |
| 6,740,184 | B2 | | 5/2004 | Mortellite et al. |
| 2005/0158099 | A1 | | 7/2005 | Segerer et al. |
| 2006/0135649 | A1 | | 6/2006 | Jedlicka et al. |
| 2007/0292665 | A1 | | 12/2007 | Fukunaga et al. |

FOREIGN PATENT DOCUMENTS

| | | | |
|---|---|---|---|
| JP | 59168146 | A | 9/1984 |
| JP | H01297414 | A | 11/1989 |
| JP | H0284439 | A | 3/1990 |
| JP | 2003-226769 | A | 8/2003 |
| JP | 2004052114 | | 2/2004 |
| RU | 2142878 | C1 | 12/1999 |
| SU | 1125315 | A1 | 11/1984 |
| WO | 94/12328 | A1 | 6/1994 |

* cited by examiner

CHILLER BOX

This application claims the benefit of U.S. provisional application 61/116,826 filed on Nov. 21, 2008, the complete disclosure of which is hereby incorporated herein by reference for all purposes.

The present invention is related to the commonly assigned copending patent application entitled "Coating Composition Coating Compositions and Coated Substrates for Articles of Manufacture used in Contact with Human Body Surfaces," U.S. Ser. No. 61/116,785, filed on Nov. 21, 2008.

BACKGROUND OF THE INVENTION

The present invention relates to coating compositions for flexible, sheet-like substrates, coated flexible, sheet-like substrates for articles of manufacture used in contact with human body surfaces, and a process for adding waxy compositions to flexible, sheet-like substrates. The present invention is particularly useful for coating compositions for flexible, sheet-like substrates, coated flexible, sheet-like substrates used in the manufacture of disposable absorbent articles, specifically suited for coated flexible, sheet-like substrates used in the manufacture of tampons.

There are several methods of delivering waxy compositions to their intended targets, including but not limited to oral, topical, and transdermal methods. Disposable absorbent articles can be used as vehicles for topical delivery to the vaginal canal, perineum, and related areas, as well as for treatment sites for the discharged fluids to come in contact with the waxy compositions, as they are captured by the product.

Waxy materials tend to be somewhat tacky, and difficulties arise in particular with regard to the handling of sheets coated or impregnated with such waxy materials during their production. The sheet and its waxy material tend to stick to machine parts and to foul the machinery with consequent process interruption and time loss due to machinery downtime and maintenance.

GB 2287481 purports to disclose a process for manufacturing a wax impregnated cloth material. In this process, a cloth web is led through a bath of liquid wax. The web is then led to remote cooling rollers. As the web travels to the cooling rollers, a fan directs a cooling air stream along an upper face of the web. The web is further cooled around the cooling rollers. Circulating a refrigerant therethrough cools all of the cooling rollers. The cooled web is then wound up at a reeling station.

Yang, U.S. Pat. No. 6,316,019 discloses a process for making a tampon including the application to a substrate of a solution containing a pharmaceutically active compound. The solution is liquid at a temperature of less than about 35° C., and it is applied to the disposable absorbent article at a temperature of less than 40° C. While this is an advance in the art, the ability to add substantial amounts of the pharmaceutically active compound to the substrate to form a robust and flexible coated material is limited.

The present invention is directed towards overcoming these problems, and to provide a process for manufacturing sheets coated or impregnated with such waxy materials that is efficient and trouble free in operation.

SUMMARY OF THE INVENTION

We have found a process for manufacturing sheets coated or impregnated with such waxy materials that is efficient and trouble free in operation.

In one embodiment of the invention, a process for manufacturing robust, flexible sheet-like material, comprising the steps of a) applying a waxy composition to the web to form a waxed web; b) leading the waxed web via at least one roller to a chiller; c) cooling the waxed web; and d) leading the waxed web to a collection station for collecting the waxed web for further processing.

The waxy composition comprises about 10-60 wt-% of a waxy compound and about 90-40 wt-% of a diluent. The waxy compound is selected from the group consisting of A) monoesters of a polyhydric aliphatic alcohol and a fatty acid containing from eight to eighteen carbon atoms and wherein said monoester has at least one hydroxyl group associated with its aliphatic alcohol residue; B) diesters of a polyhydric aliphatic alcohol and a fatty acid containing from eight to eighteen carbon atoms and wherein said diester has at least one hydroxyl group associated with its aliphatic alcohol residue; and C) mixtures of said monoesters and diesters. The coating forms a stable liquid mixture at a temperature between about 35° C. and about 100° C., has a liquefaction temperature of at least about 30° C., and has a contact angle with a flat surface of the substrate of less than about 35° when measured at a temperature of 60° C. In one preferred embodiment, the chiller has a cooling source comprising a liquefied gas, preferably having a temperature of less than about −100° C., more preferably with a temperature of less than about −120° C., and most preferably with a temperature of less than about −150° C.

The step of applying a waxy composition to the web to form a waxed web may include contacting the web with a liquid having a temperature of between about 45° C. and about 75° C.

The waxed web may be cooled to a surface temperature of less than about 0° C., more preferably less than about −20° C.

DETAILED DESCRIPTION OF THE INVENTION

Figure 1:
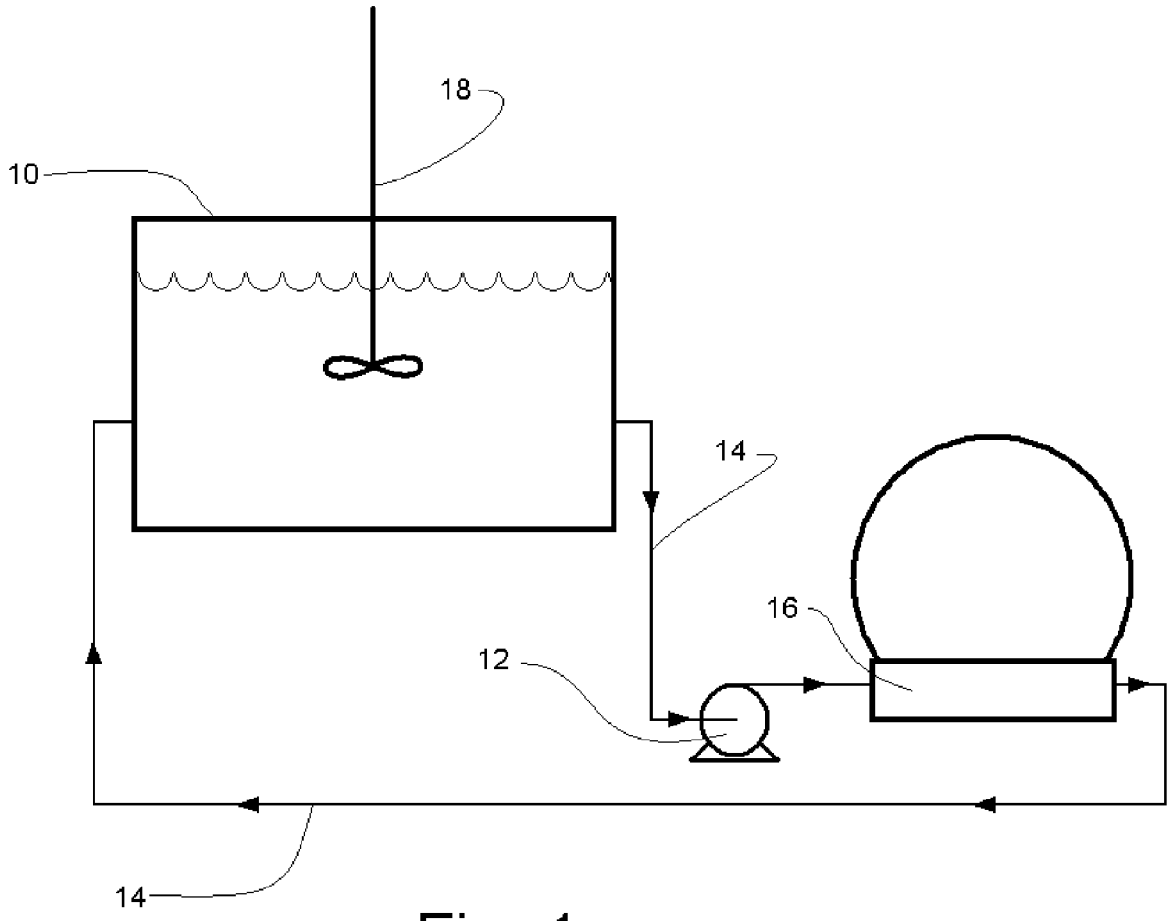
FIG. 1 is schematic diagram of a liquid coating composition circulation system useful in the present invention.

As used herein the specification and the claims, the term "coating composition" and variants thereof includes compositions that may be applied to a flexible, sheet-like substrate in a liquid state and cooled and/or cured to a solid state at room temperature. The term and its variants relates to coating and impregnating processes.

As used herein the specification and the claims, the term "liquefaction temperature" is the temperature corresponding to the first solid-to-liquid heat absorption peak determined via Differential Scanning Calorimetry. DSC (Differential Scanning Calorimetry) is a thermo analytical method. It measures the difference in the amount of heat required to increase the temperature of a sample and reference. A DSC (TA Instruments Model Q 200, with Universal Analysis 200 software V4.4A, Aluminum sample pans with hermetic lids) is used to study the phase transition from solid to liquid of a formulation. A formulation in liquid state is added to a pre-weighed aluminum DSC sample pan. The final sample weight was recorded and the sample pan sealed with a hermetic lid. Sample weights are in the range of 6 to 10 milligrams.

The DSC measurement for each sample is run a heat/cool/heat series. The sample starts out at 25° C. and heat is increased at a constant rate of 10 degree/min to a max of 80° C. The sample is then cooled to −20° C., and reheated to 80° C. with both cooling and heating rate of 10 degree/min. The liquefaction temperature is defined and measured as the maximum of the first heat cycle or the first peak of the DSC chart.

According to the present invention, a heated coating composition comprising a waxy component is applied to a moving flexible, sheet-like substrate. The wet substrate is then chilled to solidify the coating composition to provide a robust, flexible sheet-like material.

In particular, a coating composition is prepared by providing at least one liquid to a heated coating supply tank 10. Preferably, the liquid is provided at a temperature close to the temperature at which it will be applied to the substrate, and the liquid is circulated through the system, e.g., pump 12, conduits 14, coating tray 16, etc., to bring the system up to coating temperature. The circulation through the coating system may then be temporarily stopped while at least one waxy composition is added and liquefied in the heated coating supply tank while the liquid mixture is agitated, e.g., by means of a stirrer 18. After addition of waxy composition is complete and the tank is at the operating temperature, circulation may be restarted to maintain the operating temperature throughout the system.

The present invention also relates to a liquid coating composition comprising the waxy component and a diluent, which liquid composition forms a stable liquid mixture at a temperature between about 35° C. and about 100° C., has a liquefaction temperature of at least about 30° C., and has a contact angle with a flat surface of the substrate of less than about 35° when measured at a temperature of 60° C.

One advantage the present invention provides is that the coated substrate is surprisingly robust. We have found that the resulting coating neither flakes off of the substrate nor is significantly rubbed off of the substrate during processing. This permits economic, high-speed processing of the coated substrate to form an article of manufacture used in contact with human body surfaces.

As used in this specification and the appended claims, liquid is defined to be a substance that has a definite volume but no definite form except such as given by its container. A solution is defined herein to be a homogeneous mixture of a substance (solid, liquid, or gas) dissolved in a liquid, the solvent.

As used herein, the term "surfactant" refers to a surface active agent, i.e., one that modifies the nature of surfaces. Surfactants are often used as wetting agents, detergents, emulsifiers, dispersing agents, penetrants, and antifoaming agents. Surfactants may be anionic, cationic, nonionic and ampholytic. Preferably, the surfactant used in the present invention is a nonionic surfactant. Nonionic surfactants are generally less irritating of human body tissue, and they are therefore more acceptable in uses that contact such tissue.

As used herein, the term "hydrophilic agent" refers to a substance that readily associates with water, and the term "lyophilic agent" refers to an agent that attracts lipids in a colloid system, describing a colloidal system in which the dispersed phase is a lipid and attracts the dispersing medium. One measure of the relative hydrophilicity and lyophilicity of an agent is the HLB or hydrophile-lyophile balance with a high HLB reflecting a relatively hydrophilic agent and a low HLB reflecting a relatively lyophilic agent. Preferably the lyophilic agents have an HLB of less than about 10, more preferably, less than about 8, and most preferably, less than about 5.

The waxy compositions useful in the present invention used in the present invention are useful to inhibit the production of toxins by various bacteria as disclosed in Brown-Skrobot and Brown-Skrobot et al., U.S. Pat. Nos. 5,389,374; 5,547,985; 5,641,503; 5,679,369; and 5,705,182, all of which are incorporated by reference. These compositions are selected from the group consisting of: monoesters of a polyhydric aliphatic alcohol and a fatty acid containing from eight to eighteen carbon atoms and wherein said monoester has at least one hydroxyl group associated with its aliphatic alcohol residue; diesters of a polyhydric aliphatic alcohol and a fatty acid containing from eight to eighteen carbon atoms and wherein said diester has at least one hydroxyl group associated with its aliphatic alcohol residue; and mixtures of said monoesters and diesters. Preferably, the active composition is glycerol monolaurate.

The diluents of the present invention are compatible with both the waxy composition and the substrate to which the liquid composition will be applied. The diluent may be a single component or may be a multi-component system. A single component diluent may be selected based upon its compatibility with the waxy component. For example, employing GML as the waxy component (HLB of 5.2, one may select diluents with a similar HLB, preferably an HLB of 5.2+/− about 2. If it is desired to impart other properties (such as wettability by an aqueous liquid) by employing a diluent such as a hydrophilic olefinic diol, an additional diluent, such as a surfactant having an HLB similar to GML, e.g., about 3.2 to about 7.2, can be incorporated to form a two-component diluent.

The olefinic diols of the present invention are highly hydrophilic and/or very miscible with water. Thus, aqueous bodily fluids that may be absorbed by absorbent structures treated with the present solution will have a greater affinity for such structures than for structures treated with the waxy composition of the present invention in the absence of the olefinic diol.

A representative, non-limiting list of useful diols includes $C_{2-8}$ diols and polyglycols, and the like. Preferably, the diol is selected from the group consisting of glycols ($C_2$ and $C_3$ diols) and polyglycols. As used in the specification and the claims, the term "polyglycol" refers to a dihydroxy ether formed by dehydration of two or more glycol molecules. A representative, non-limiting list of useful polyglycols includes ethylene glycol, propylene glycol, polyethylene glycols, polypropylene glycols, methoxypolyethylene glycols, polybutylene glycols, or block copolymers of butylene oxide and ethylene oxide. Among the aforementioned polyglycols, polyethylene glycol having a molecular weight of less than about 600, and polypropylene glycol having a molecular weight of less than about 4,000, are preferred.

Other diluents or diluent components may include surfactants, such as fatty acid esters and ethoxylated sugar derivatives. Preferred fatty acid esters include sorbitan fatty acid esters. A representative, non-limiting list of useful sorbitan fatty acid esters includes sorbitan monooleate (HLB: 4.3), sorbitan monostearate (HLB: 4.7), sorbitan monopalmitate (HLB: 6.7), sorbitan monolaurate (HLB: 8.6), sorbitan tristearate (HLB:

2.1), and sorbitan trioleate (HLB: 1.8). Among the aforementioned sorbitan fatty acid esters, sorbitan monooleate is most preferred.

Preferred ethoxylated sugar derivatives include the class of methyl glucose derivatives. A representative, non-limiting list of useful methyl glucose derivatives includes methyl gluceth-10, methyl glucose-20, methyl glucose-20 distearate, methyl glucose dioleate (HLB: 5), and methyl glucose sesquistearate (HLB: 6), PEG-120 methyl glucose dioleate, and PEG-20 methyl glucose sesquistearate.

Other diluents or diluent components may include mono-, di-, or triglycerides that have an HLB value between about 3 and about 10, preferably between about 3 and about 7.5, including without limitation, caprylic/capric triglyceride (HLB of 5), available as NEOBEE® M-5 caprylic/capric triglyceride from Stephan Company Northfield, Ill., USA; oleic triglyceride (HLB of 7), available as FLORASUN 90 from International Flora Technologies, Ltd, Chandler, Ariz., USA.

Preferably, the liquid mixture includes about 10 to about 60 wt % of the waxy component and about 90 to about 40 wt-% of the diluent, more preferably about 20 to about 50 wt % of the waxy component and about 70 to about 50 wt-% of the diluent.

Diluent systems comprising hydrophilic and lyophilic diluent components may take the ranges shown below in Table 1:

TABLE 1

| | Hydrophilic component(s) (wt-%) | Lyophilic component(s) (wt-%) |
|---|---|---|
| Useful | 0-100 | 100-0 |
| Preferred | 25-80 | 75-20 |
| More preferred | 40-75 | 60-25 |
| Most preferred | 50-70 | 50-30 |

An example of the preparation of the liquid composition of the present invention is described below with reference to a particular system comprising glycerol monolaurate as the waxy component and a multi-component diluent system. Other liquid compositions may be similarly prepared, whether there is more than one waxy component or whether there is only one diluent. Generally, the diluent or diluent system will be heated to a temperature at which the waxy component(s) will be liquefied in combination with the diluent. The mixture will be agitated to ensure sufficient component homogeneity, and the waxy component(s) will be added at a rate at which the liquid mixture can be maintained without solidification.

In one preferred embodiment, the liquid composition may be prepared by combining an olefinic diol and a surfactant agent while stirring and heating to about 60° C. to form the diluent. While continuing to stir, the waxy substance may be added to the diluent, and the heat maintained. In the example of glycerol monolaurate, PEG-400 and sorbitan monooleate (SPAN 80), the glycerol monolaurate may be added at a rate that does not cause the temperature of the solution to drop below 52° C. We have found that this mixture starts to clear up at ~52° C. and completely clear at 55° C. Heating the solution to about 60° C. can substantially assure complete mixing of the coating composition.

After the solution is prepared, in accordance to the description above, it is then applied to a substrate. Useful substrates include, but are not limited to, films (e.g., apertured or non-apertured), fabrics (e.g., woven, knit, or non-woven), and the like. Films may be relatively homogenous films or may be multilayered films formed by lamination, co-extrusion, and other film-forming methods. The films may be apertured to permit movement of fluids, such as gases, and more preferably liquids, through the film.

Fabric substrates may comprise absorbent and/or non-absorbent fibers, and the fibers may be homogeneous or multi-component. A representative, non-limiting list of useful fibers includes, without limitation, cellulose, rayon, nylon, acrylic, polyester, polyethylene, polypropylene, ethylene vinyl acetate, polyurethane, and the like. Multi-component fibers may be bicomponent or more and may have a sheath/core configuration, a side-by-side configuration, or other configuration that would be recognized by one of ordinary skill in the art.

A representative, non-limiting list of useful non-woven fabrics includes spunbonded fabric, thermal bonded fabric, resin bonded fabric, hydroentangled fabric, spun-lace fabric, meltblown fabric, needlepunched fabric, and the like; apertured and non-apertured films.

The coating composition may be applied to the flexible, sheet-like substrate in ways known to those of ordinary skill in the art. A representative, non-limiting list of useful application methods includes dip, immersion, roller-transfer, kiss-coating, spray, doctor blade, gravure, relief print, and the like.

The coating composition is provided in or to the coating station in a heated coating supply tank, discussed above. As the wet substrate leaves the coating equipment, it may be conveyed in a suspended manner between rollers. This permits some initial air-cooling of the wet substrate and reduces the transfer of coating composition from the substrate to its surroundings. In the event that the substrate is coated on only one surface, it can be beneficial to support the substrate on the uncoated surface. In the event that the substrate is impregnated or otherwise coated on both surfaces, the roller(s) may be heated to maintain the liquid state of the coating to again minimize loss of the coating composition. It may also be desirable to eliminate such conveying rollers between the coating equipment and the chiller.

The chiller 100 includes an enclosure 102 that has an inlet 104 and an outlet 106, substrate transport elements 108, and temperature control means. The inlet and outlet are sized to accommodate the coated substrate 110 with minimal clearance to reduce temperature exchange between the interior of the enclosure and its surroundings. The transport elements 108 may be rollers that are arranged and configured to minimize loss of the coating composition. Again, the rollers may be generally disposed on the uncoated surface of the substrate, if possible. The temperature control means may include a cooling source 112, one or more temperature sensors (not shown), and feedback loop, control circuits, gauges, valves, etc. (also not shown) to maintain a constant temperature within the chiller. The chiller is preferably maintained with a cooling source at a temperature below about −120° C., preferably below about −180° C. This may provide a cooled gas within the chiller below about −120° C. The chiller may have circulation and/or ventilation components. The cooling source may be any suitable coolant. A representative, non-limiting list of useful cooling sources includes FREON®, ammonia, liquefied gases, such as liquid nitrogen.

Figure 2:
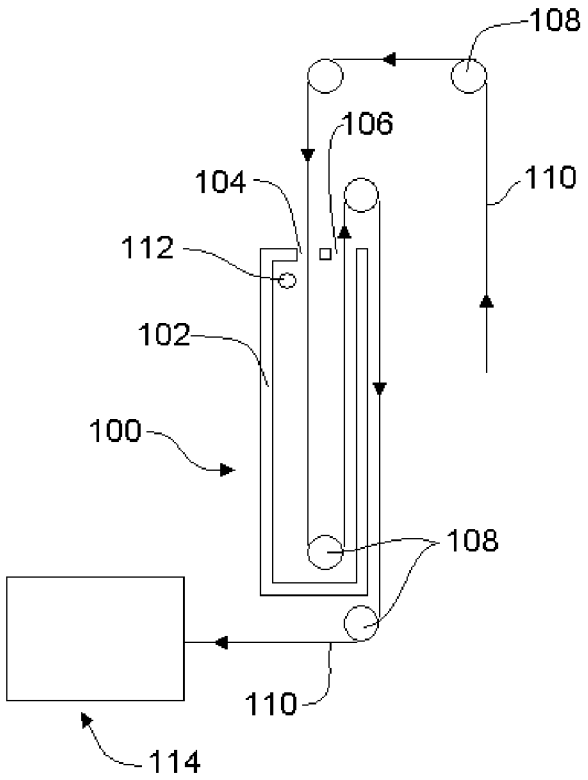
FIG. 2 is a schematic diagram of one embodiment of a chiller useful to rapidly cool coated substrates according to the present invention.

Several different embodiments of the chiller 100 are shown in FIGS. 2-7. Referring to FIG. 2, a simple, compact chiller 100 having an inlet 104 and an outlet 106 located at the top of the enclosure 102 is shown. Rollers 108 are arranged to contact an uncoated surface of the coated substrate 110 both leading up to and inside of the enclosure 102. Only after exiting the outlet 106 does a roller 108 contact the coated surface of the flexible, sheet-like substrate. A cooling source 112, such as a dispenser for liquid nitrogen, is located proximate the inlet 104. After the coated substrate 110 is cooled to less than about −20° C., it is a robust, flexible sheet-like material that can be further processed at stations generally designated at 114 in the drawing.

Figure 3:
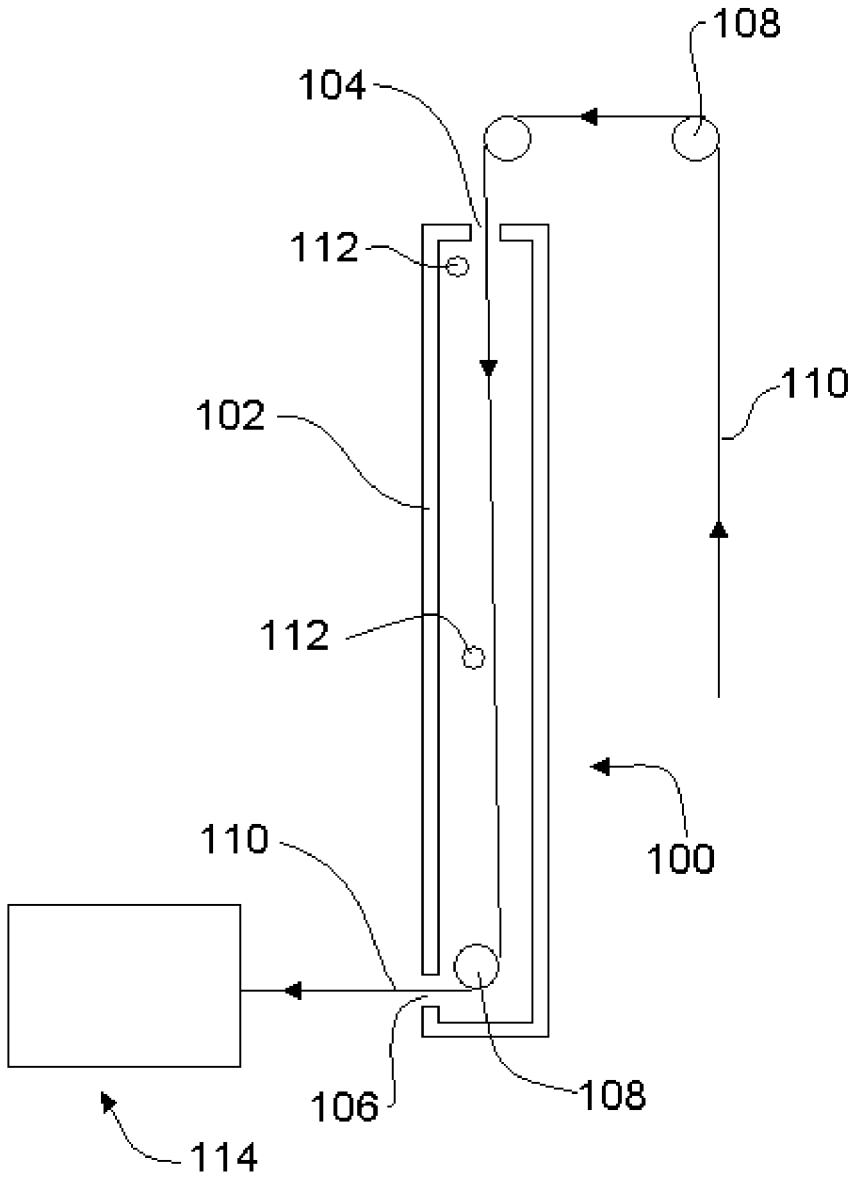
FIG. 3 is a schematic diagram of an alternate embodiment of a chiller useful to rapidly cool coated substrates according to the present invention.

Referring to FIG. 3, an alternative, vertical chiller 100 is shown. In this embodiment, the inlet 104 is located at the top of the enclosure 102, while the outlet 106 is located at the bottom. Again, rollers 108 are arranged to contact an uncoated surface of the coated substrate 110 until adjacent the outlet 106. A plurality of cooling sources 112 are located proximate the inlet 104 and approximately halfway down the enclosure 102.

Figure 4:
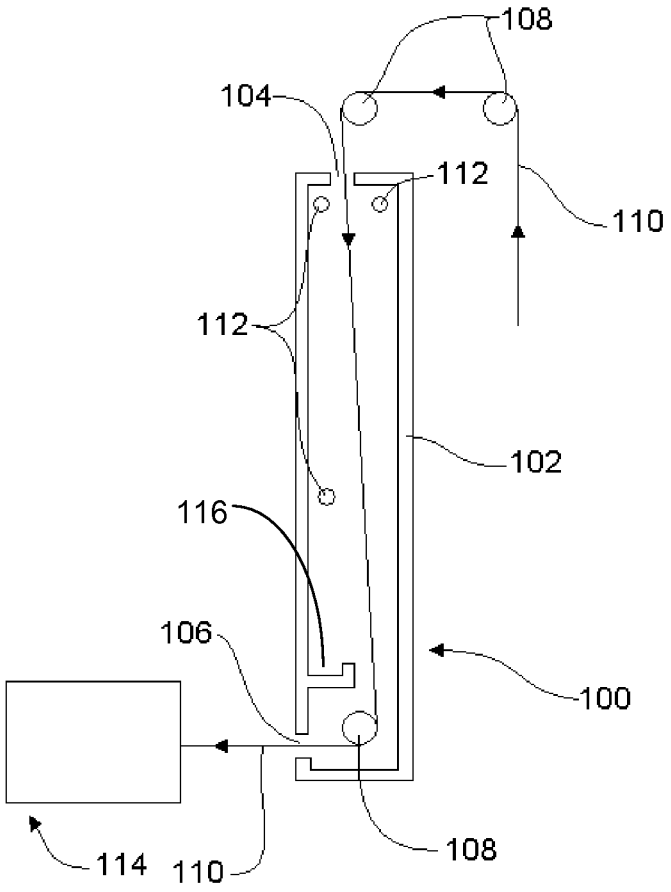
FIG. 4 is a schematic diagram of an alternate embodiment of a chiller useful to rapidly cool coated substrates according to the present invention.

FIG. 4 shows an alternative embodiment of the vertical chiller 100 of FIG. 3. This embodiment incorporates a collection trough 116 disposed below the cooling sources 112. The collection trough 116 prevents a liquid cooling source, such as liquid nitrogen, from falling directly onto the coated substrate as it approaches the outlet 106.

Figure 5:
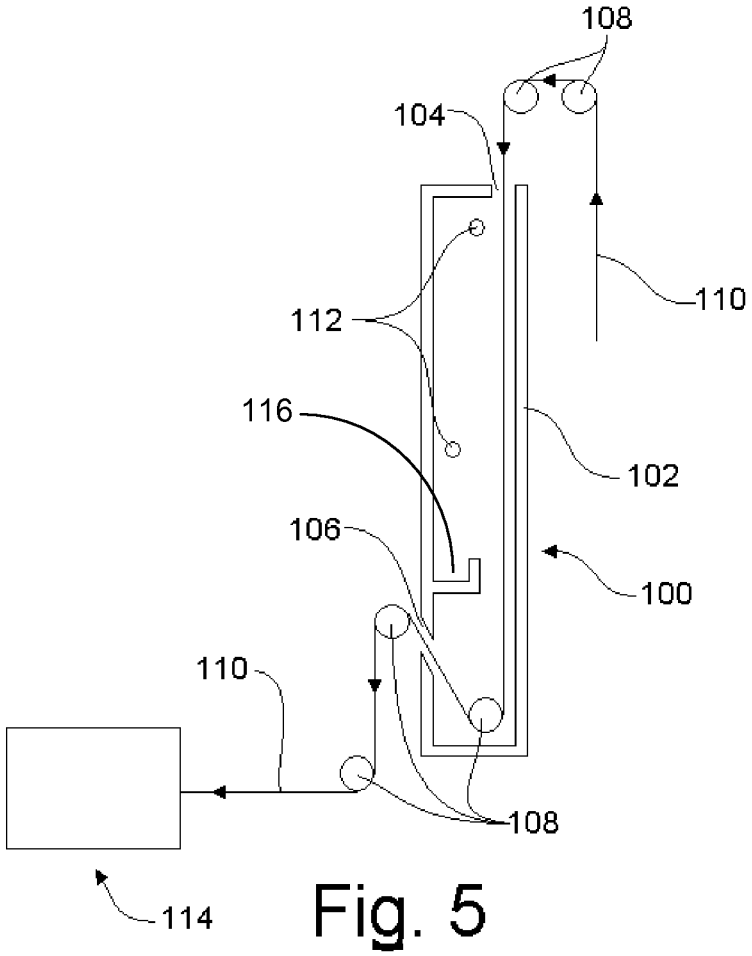
FIG. 5 is a schematic diagram of an alternate embodiment of a chiller useful to rapidly cool coated substrates according to the present invention.

FIG. 5 shows a modification of the vertical chiller of FIG. 4. In this embodiment, the outlet 106 is angled upward from the bottom roller 108 of the chiller 100. This permits the cold gas to remain more captured within the confines of the enclosure 102. In the example of liquid nitrogen as the cooling source, this modification helps to capture any excess liquid and allow it to evaporate within the enclosure 102 and add to the cooling process.

Figure 6:
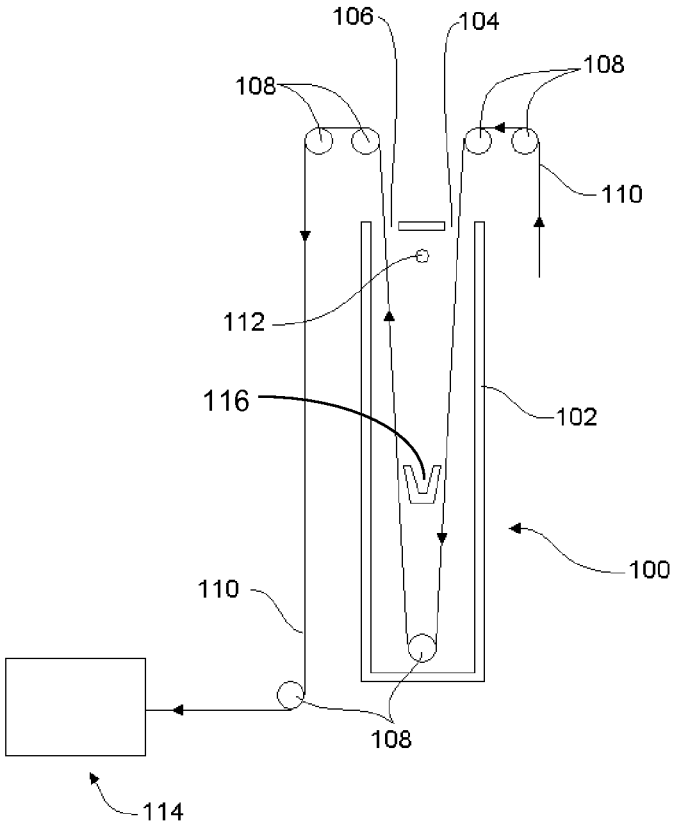
FIG. 6 is a schematic diagram of an alternate embodiment of a chiller useful to rapidly cool coated substrates according to the present invention.

FIG. 6 shows a modified compact chiller, similar to that of FIG. 2. However, a collection trough 116 is located below the cooling source 112. Additionally, this embodiment provides sufficient cooling of the coated substrate 110 that the roller 108 at the bottom of the enclosure 102 may contact the coated surface of the substrate without significant risk of coating loss.

Figure 7:
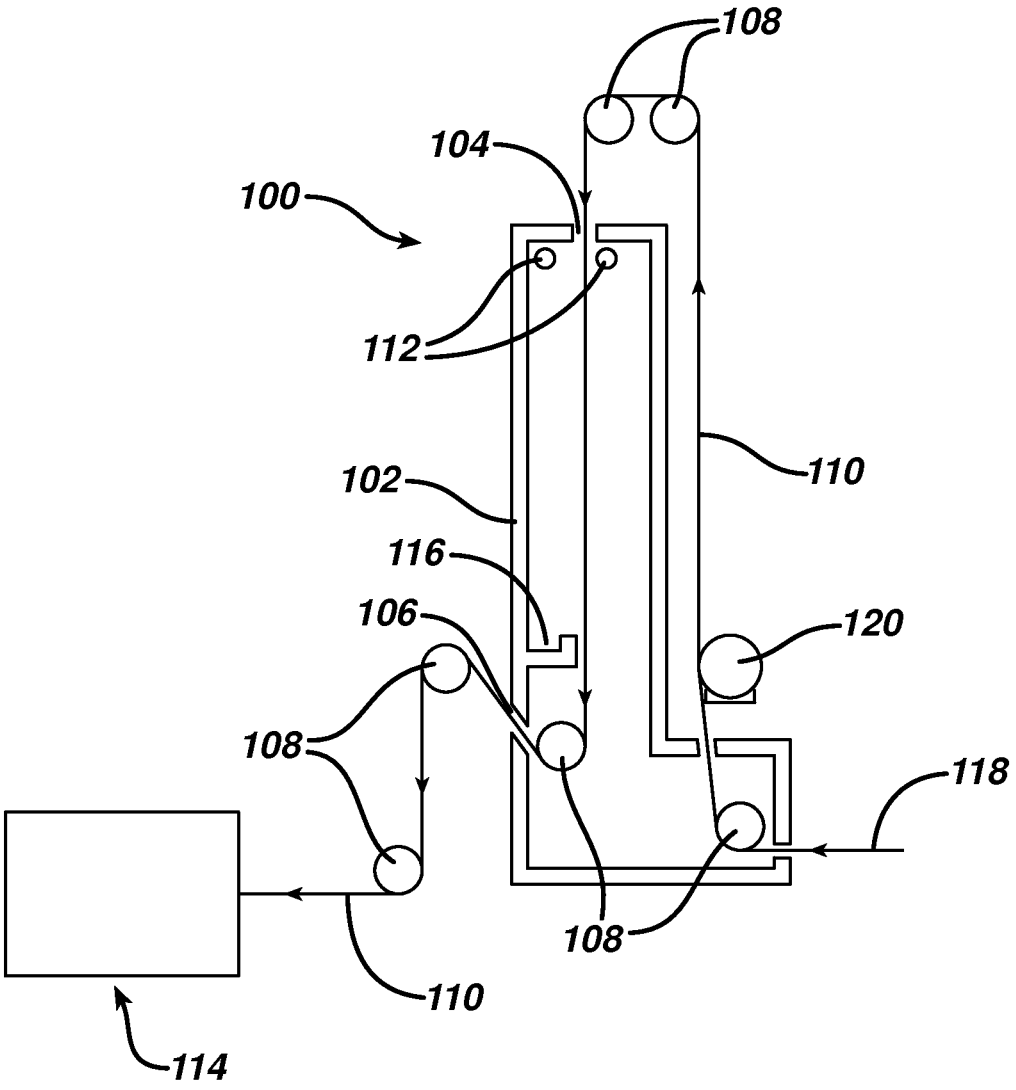
FIG. 7 is a schematic diagram of an alternate embodiment of a chiller useful to rapidly cool coated substrates according to the present invention.

FIG. 7 shows yet another modification of the chiller. In this embodiment, the uncoated substrate 118 traverses a lower portion of the enclosure 102 to precool it prior to applying the coating composition, e.g., with a kiss-coater 120. The wet substrate 110 is then conveyed into the chiller 100 that is otherwise similar to that of FIG. 5.

As mentioned above, after exiting the chiller 100, the robust, flexible sheet-like material may be further processed at stations generally designated at 114 in the drawing. This further processing may include slitting and winding up on spools for storage and/or transportation. Additional further processing may include combining with other element to form articles of manufacture, such as disposable absorbent articles, specifically suited for coated flexible, sheet-like substrates used in the manufacture of tampons.

The invention is not limited to the embodiments hereinbefore described which may be varied in both construction and detail.

What is claimed is:

1. A process for manufacturing a film, comprising the steps:

a) applying a coating liquid having a temperature of greater than 35 ° C. to about 100 ° C. comprising:

i) about 10-60 wt-% of a waxy compound selected from the group consisting of:

A) monoesters of a polyhydric aliphatic alcohol and a fatty acid containing from eight to eighteen carbon atoms and wherein said monoester has at least one hydroxyl group associated with its aliphatic alcohol residue;

B) diesters of a polyhydric aliphatic alcohol and a fatty acid containing from eight to eighteen carbon atoms and wherein said diester has at least one hydroxyl group associated with its aliphatic alcohol residue; and C) mixtures of said monoesters and diesters; and ii) about 90-40 wt-% of a diluent;

to a polymeric film, wherein the coating liquid forms a stable liquid mixture at a temperature between about 35 ° C. and about 100 ° C., has a liquefaction temperature of at least about 30 ° C., and has a contact angle with a flat surface of the polymeric film of less than about 35° when measured at a temperature of 60 ° C.;

b) leading the coated polymeric film via at least one roller to a chiller comprising an enclosure and having a cooling source having a temperature of less than about −120 ° C.;

c) cooling the coated polymeric film to form a, flexible, waxed film; and d) leading the waxed film to a collection station for collecting the waxed film for further processing.

2. The process of claim 1, wherein the step of applying the coating liquid to the polymeric film comprises contacting the polymeric film with the coating liquid having a temperature of between about 45 ° C. and about 75 ° C.

3. The process of claim 1, wherein the cooling source has a temperature of less than about −150 ° C.

4. The process of claim 1, wherein the coated polymeric film is cooled to a temperature of less than about −20 ° C.

5. The process of claim 1, wherein the polymeric film is an apertured film.

* * * * *